US010689794B2

(12) United States Patent
Janakiraman et al.

(10) Patent No.: US 10,689,794 B2
(45) Date of Patent: Jun. 23, 2020

(54) AUTOMATED SELECTION OF SETTINGS FOR AN IRONING DEVICE

(71) Applicant: International Business Machines Corporation, Armonk, NY (US)

(72) Inventors: Janani Janakiraman, Austin, TX (US); Megan D. Kostick, Edmonds, WA (US); Dany R. Madden, Beaverton, OR (US); Meenakshi Sripal, Saint Louis, MO (US)

(73) Assignee: International Business Machines Corporation, Armonk, NY (US)

( * ) Notice: Subject to any disclaimer, the term of this patent is extended or adjusted under 35 U.S.C. 154(b) by 222 days.

(21) Appl. No.: 15/972,683

(22) Filed: May 7, 2018

(65) Prior Publication Data

US 2018/0251935 A1 Sep. 6, 2018

Related U.S. Application Data

(63) Continuation of application No. 14/554,256, filed on Nov. 26, 2014, now Pat. No. 9,994,993.

(51) Int. Cl.

| | |
|---|---|
| ***D06F 75/26*** | (2006.01) |
| ***D06F 75/10*** | (2006.01) |
| ***D06F 75/08*** | (2006.01) |
| ***D06F 75/40*** | (2006.01) |

(52) U.S. Cl.

CPC ..... *D06F 75/10* (2013.01); *D06F 75/26* (2013.01); *D06F 75/40* (2013.01); *D06F 75/08* (2013.01)

(58) Field of Classification Search

None

See application file for complete search history.

(56) References Cited

U.S. PATENT DOCUMENTS

| | | | |
|---|---|---|---|
| 1,331,107 | A | 2/1920 | Holtzman |
| 2,164,085 | A | 6/1939 | Rossen |
| 5,074,065 | A | 12/1991 | Allenbach |
| 5,345,060 | A | 9/1994 | Hazan et al. |
| 5,353,355 | A | 10/1994 | Takagi et al. |

(Continued)

FOREIGN PATENT DOCUMENTS

| | | | |
|---|---|---|---|
| JP | 2004195064 A | * | 7/2004 |
| WO | 2005054564 A1 | | 6/2005 |

OTHER PUBLICATIONS

Hasegawa et al., "Fabrication of a wearable fabric tactile sensor produced by artificial hollow fiber," Journal of Micromechanics and Microengineering 18 (2008) 085014 (8pp), doi:10.1088/0960-1317/18/8/085014, © 2008 IOP Publishing Ltd Printed in the UK, 0960-1317/08/085014, 9 pages.

(Continued)

*Primary Examiner* — Joseph M Pelham

(74) *Attorney, Agent, or Firm* — Peter J. Edwards

(57) ABSTRACT

Embodiments provide a method and device that enables automatic selection of settings for ironing one or more pieces of fabric. A digital camera on an ironing device captures an image of a fabric. A wireless communication device on the ironing device communicates the image to a remote computing system for digital image processing to determine a fabric type and to select a set of settings based on the fabric type. The wireless communication device receives the set of settings from the remote computing system. The set of settings are applied to the ironing device.

12 Claims, 7 Drawing Sheets

(56) References Cited

U.S. PATENT DOCUMENTS

| | | | | |
|---|---|---|---|---|
| 5,475,201 | A * | 12/1995 | Pike | D06F 75/26 219/250 |
| 5,642,578 | A | 7/1997 | Hazan et al. | |
| 5,642,579 | A | 7/1997 | Netten et al. | |
| 6,581,309 | B1 | 6/2003 | Conforti | |
| 7,340,853 | B2 | 3/2008 | Ching et al. | |
| 7,923,661 | B2 | 4/2011 | Lee | |
| 8,800,180 | B2 | 8/2014 | Ong et al. | |
| 9,879,373 | B2 | 1/2018 | Janakiraman et al. | |
| 9,945,066 | B1 * | 4/2018 | Mutton | D06F 75/26 |
| 2001/0049846 | A1 | 12/2001 | Guzzi et al. | |
| 2005/0196046 | A1 | 9/2005 | Hudnut et al. | |
| 2006/0081588 | A1 | 4/2006 | Bowser et al. | |
| 2006/0207986 | A1 | 9/2006 | Brown | |
| 2008/0052970 | A1 | 3/2008 | Lee | |
| 2008/0189993 | A1 | 8/2008 | Cavada | |
| 2009/0265964 | A1 | 10/2009 | Jiang et al. | |
| 2010/0102076 | A1 | 4/2010 | Hendrickson et al. | |
| 2010/0242314 | A1 | 9/2010 | Aiura | |
| 2011/0117663 | A1 | 5/2011 | Brun et al. | |
| 2012/0250946 | A1 | 10/2012 | Kitagawa et al. | |
| 2012/0304778 | A1 | 12/2012 | Nakamura et al. | |
| 2013/0125427 | A1 | 5/2013 | De Vries et al. | |
| 2014/0018962 | A1 | 1/2014 | Jung et al. | |
| 2014/0021191 | A1 | 1/2014 | Moon et al. | |
| 2014/0346899 | A1 | 11/2014 | Chou | |
| 2015/0070703 | A1 | 3/2015 | Tin et al. | |
| 2015/0345073 | A1 | 12/2015 | Al-Zahrani | |
| 2016/0145794 | A1 | 5/2016 | Janakiraman et al. | |
| 2016/0273144 | A1 | 9/2016 | Koike et al. | |
| 2016/0319477 | A1 * | 11/2016 | Janakiraman | D06F 75/26 |
| 2018/0030646 | A1 * | 2/2018 | Kumar | D06F 43/002 |

OTHER PUBLICATIONS

Kang et al., "Automatic Recognition of Fabric Weave Patterns by Digital Image Analysis," Textile Research Journal, 1999 69:77, DOI: 10.1177/004051759906900201, http://trj.sagepub.com, 8 pages.

Kinoshita et al., "Determination of Weave Type in Woven Fabric by Digital Image Processing," Faculty of Textile Science, Kyoto Institute of Technology, Matsugasaki, Sakyo-ku-Kyoto 606, based on the Journal of the Textile Machinery Society of Japan, Proceedings, vol. 40, No. 11, (Nov. 1987), 4 pages.

Kita et al., "Large-sized fabric tactile sensors for detecting contacted subjects," Micro & Nano Letters, 2010, vol. 5, Iss. 6, pp. 389-392, doi: 10.1049/mnl.2010.0130, Copyright The Institution of Engineering and Technology 2010.

Oliso, "The Oliso Smart Iron Difference, Friendlier, Powerful Steam Zero-Drip," http://www.oliso.com.steam-iron (last accessed Sep. 5, 2014 3:39 PM), 2 pages.

Hitachi, "Washing Machines' Features," http://www.hitachi-sales.ae/eng/featurehighlight/washingmachines.html (last accessed Nov. 21, 2014 1:41 PM); © Hitachi Sales Middle East FZE, 1994, 2014, 15 pages.

Kuo et al., "Application of computer vision in the automatic identification and classification of woven fabric weave patterns," Textile Research Journal, Dec. 2010, vol. 80, No. 20 2144-2157, published online before print Aug. 20, 2010, DOI: 10.1177/0040517510373630, Abstract—1 page.

"Accelerated Examination Support Document," International Business Machines Corporation, Dated Jul. 19, 2016, 10 pages.

List of IBM Patents or Patent Applications Treated as Related, dated May 3, 2018, 2 pages.

* cited by examiner

AUTOMATED SELECTION OF SETTINGS FOR AN IRONING DEVICE

BACKGROUND

The present disclosure relates to ironing devices, and more specifically, to automated selection of settings on ironing devices.

Ironing devices typically include a soleplate which is heated and applied to fabrics to smooth out the fabric. Ironing devices can also include a steam generator which produces steam to be applied to the fabric. The ideal temperature of the soleplate and the ideal amount of steam applied to the fabric may be different based on the type of fabric. Higher temperatures of the soleplate may be harmful to certain fabrics and lower temperatures may be ineffective at smoothing out certain fabrics. Similarly, different amounts of steam may be applied to different fabrics to prevent damage and enhance effectiveness. The temperature of the soleplate and amount of steam produced is typically manually adjusted by a user of the ironing device.

SUMMARY

According to embodiments of the present disclosure, a method for automated selection of settings for an ironing device is disclosed. The method includes capturing, by a digital camera on an ironing device, an image of a fabric. The method further includes communicating, by a wireless communication device on the ironing device, the image to a remote computing system for digital image processing to determine a fabric type and to select a set of settings based on the fabric type. The method further includes receiving, via the wireless communication device, the set of settings from the remote computing system. The method further includes applying the set of settings to the ironing device.

Further disclosed herein are embodiments of an ironing device for automated selection of settings. The device includes a soleplate and a thermostat configured maintain the soleplate at a set temperature. The device further includes a digital camera configured to capture a digital image of the fabric and a wireless communication device configured to transmit the digital image of the fabric to a remote computing system for processing and configured to receive a set of settings from the remote computing system which includes a temperature setting. The device further includes a settings control module configured to receive the set of settings from the wireless communication device and adjust the set temperature of the thermostat based on the temperature setting.

Further disclosed herein are embodiments of another method for automated selection of settings for an ironing device. The method includes receiving, from an ironing device with a wireless communication device, a digital image of a fabric. The method further includes determining a fabric type based on the digital image of the fabric. The method further includes identifying, in an iron settings database, a set of settings associated with the fabric type. The iron settings database includes a plurality of fabric types and iron settings associated with each of the fabric types. The method further includes communicating the set of settings to the ironing device.

The above summary is not intended to describe each illustrated embodiment or every implementation of the present disclosure.

BRIEF DESCRIPTION OF THE SEVERAL VIEWS OF THE DRAWINGS

The drawings included in the present application are incorporated into, and form part of, the specification. They illustrate embodiments of the present disclosure and, along with the description, serve to explain the principles of the disclosure. The drawings are only illustrative of certain embodiments and do not limit the disclosure.

Figure 1:
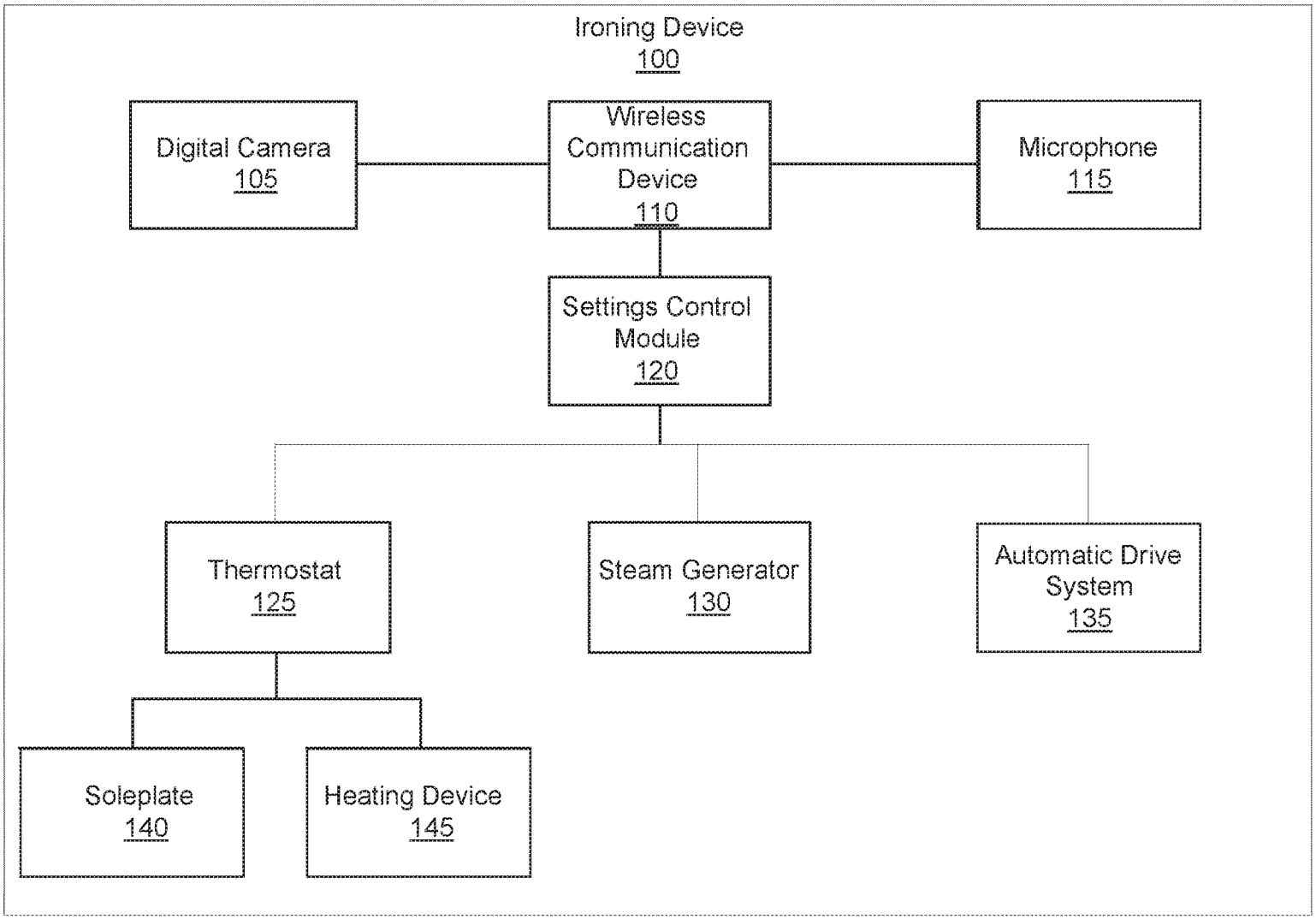
FIG. 1 depicts a block diagram of an example ironing device for automated selection of settings.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention.

DETAILED DESCRIPTION

Aspects of the present disclosure relate to automated selection of setting for an ironing device. More particularly, aspects relate to wirelessly communicating the information about the fabric from the ironing device to a remote computing system for processing and selection of settings. While the present disclosure is not necessarily limited to such applications, various aspects of the disclosure may be appreciated through a discussion of various examples using this context.

Determining the settings for an ironing device is typically a manual process which may require the user to either identify the material they are ironing and know the settings to use for the material or interpret instructions on a label, which may include cryptic symbols and give minimal detail. Additionally, instructions typically only contain an indication of the temperature setting to use without an indication of how much steam to use or what speed to move the iron.

Embodiments of the present disclosure may provide for an ironing device with automated selection of ironing settings. The ironing device includes a digital camera for capturing an image of the fabric to be ironed. The ironing device is further equipped with a wireless communication device to communicate the image to a remote computing system. The remote computing system performs digital image processing on the image to identify a fabric type. The remote computing system identifies settings for the fabric type in a settings database which contains settings for different fabric types. The remote computing system communicates the settings to the ironing device. The ironing device applies the settings which may include adjusting the temperature of the soleplate, adjusting the amount of steam produced, and adjusting the speed at which an automatic drive system moves the iron.

In some embodiments, the digital camera may also be used to take an image of a label attached to the fabric which contains ironing instructions. The image of the label may be communicated to the remote computing system to extract the ironing instructions. Optical character recognition may be used to extract text from the image and natural language processing may be used to determine the ironing instructions. Further, symbols indicating ironing instructions may be identified. Settings may be determined based on the extracted ironing instructions and the settings may be communicated to the ironing device.

In some embodiments, the ironing device further includes a microphone. The microphone may record audio containing a fabric type. For example, the microphone may record the user verbally communicating the fabric type. The audio may be sent to the remote computing system. The remote computing system may extract the fabric type from the audio using speech recognition. The fabric type may then be used to identify settings in the settings database and the settings may be communicated to the ironing device.

In some embodiments, more than one input may be used to identify settings. For example, an image of the fabric, an image of the label, and an audio recording may all be communicated to the remote computing system to determine settings. The computing system may resolve potential conflicts between the different inputs using a set of rules. For example, some inputs may take precedence over other inputs.

The settings may include a temperature setting, a steam setting, and a speed setting. The temperature setting may indicate a temperature to maintain the soleplate at. Applying the temperature setting may include adjusting a thermostat which maintains the temperature of the soleplate at a set temperature. The thermostat may monitor the temperature of the soleplate and adjust a heating device in thermal contact with the soleplate to maintain the soleplate at the set temperature. Adjusting the thermostat may include changing the set temperature.

The steam setting may indicate the amount of steam to produce by a steam generator on the ironing device. The steam generator may release steam through holes located in the soleplate. Some fabric types may not call for steam, so the steam setting may indicate that no steam should be produced.

The speed setting may indicate a speed at which the ironing device should be moved over the fabric. For example, a thicker fabric may be associated with a slower speed setting and a thinner fabric may be associated with a faster speed setting. A speed setting may be applied in embodiments of an ironing device containing an automatic drive system. The automatic drive system may include an electronic engine which drives wheels or tracks to propel the ironing device forward. When active, the automatic drive system may move the ironing device forward at a set speed. Applying the speed setting may change the set speed. Activating the automatic drive system may be performed by a user, for example, by pushing a button, pulling a trigger, or touching a touch sensor.

Settings selected may be specific to the type of ironing device. The ironing device may communicate information, such as make and model of the device, to the remote computing system. The remote computing system may select iron settings based on the iron information. The type of ironing device may determine the granularity of the settings. For example, some ironing devices may take specific temperature settings while others may take broad category settings such as cotton or silk.

In some embodiments, the ironing device may make automatic adjustments as the ironing device is moved from one fabric type to another, for example, when a garment is made of two or more fabric types. The ironing device may also alert the user of the device visually or audibly to alert the user of the changing settings. For example, the ironing device may have a light which turns on or a speaker which produces a noise. This may allow a user to remove the ironing device from the fabric as the settings are changed before the fabric is damaged by using incorrect settings. The ironing device may be able to make automatic adjustments if it continually captures images and sends them to the remote computing system. In these embodiments, the camera may be positioned toward the front of the ironing device to identify when the ironing device first moves to a new fabric type.

Referring to FIG. 1, a block diagram of an example ironing device 100 is depicted. Ironing device 100 includes digital camera 105, wireless communication device 110, microphone 115, settings control module 120, thermostat 125, steam generator 130, automatic drive system 135, soleplate 140, and heating device 145. Digital camera 105 is configured to capture images of a fabric or a label attached to the fabric. Wireless communication device 110 is configured to communicate the captured images to a remote computing system, such as a server, for processing. Wireless communication device 110 may further be configured to communicate information about ironing device 100, such as make and model, to the remote computing system. Wireless communication device 110 may be configured to use any method of wireless communication such as a wireless local area network (WLAN), Bluetooth, or cellular data. Microphone 115 is configured to record audio from a user of ironing device 100 which contains a fabric type. Wireless communication device 110 is further configured to communicate the audio to the computing system for processing.

Wireless communication device 110 is further configured to receive settings from the computing system. The settings are selected based on the images or audio communicated to the computing system. Settings control module 120 is configured to take the received settings and apply them to ironing device 100. Applying the settings may include applying a temperature setting to thermostat 125. Thermostat 125 may be configured to maintain the temperature of soleplate 140 by monitoring the temperature of soleplate 140 and adjusting the heat produced by heating device 145. Applying the temperature setting to thermostat 125 may include adjusting the set temperature at which thermostat 125 maintains soleplate 140.

Applying the settings may further include applying a steam setting to steam generator 130. Steam generator 130 may be configured to generate steam which is applied to fabric through soleplate 140. Applying the steam setting may include adjusting the amount of steam produced by steam generator 130. This may include disabling steam generator 130 if the steam setting calls for no steam.

Applying the settings may further include applying a speed setting to automatic drive system 135. Automatic drive system 135 may be configured to drive ironing device 100 at a fixed speed while ironing a fabric. Automatic drive system 135 may include an electronic motor configured to drive wheels or tracks which propel ironing device 100. Automatic drive system 135 may be activated by a user in many ways, including pushing a button, pulling a trigger, or touching a touch sensor. Applying the speed setting may include adjusting the fixed speed at which automatic drive system 135 drives ironing device 100 over a fabric while ironing.

Figure 2:
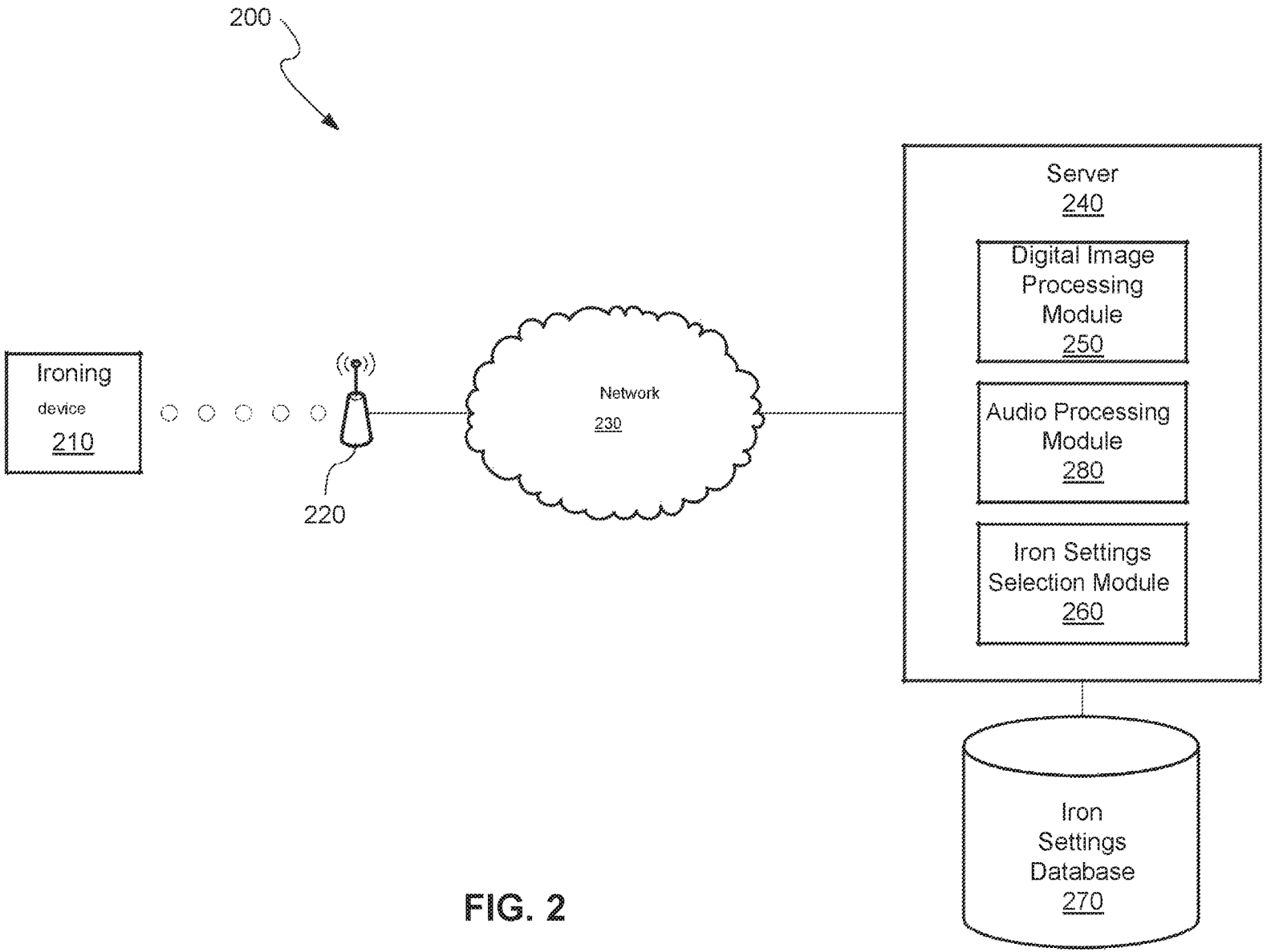
FIG. 2 depicts an example system for automated selection of ironing settings.

Referring to FIG. 2, an example system 200 for automatic selection of ironing settings is depicted. System 200 includes ironing device 210, wireless access point 220, network 230, and server 240. Ironing device 210 may wirelessly communicate images of fabric or labels, and information about ironing device 210 to server 240 via wireless access point 220 and network 230. Server 240 includes digital image processing module 250, audio processing module 280, and iron settings selection module 260.

Digital image processing module 250 is configured to process images from ironing device 210. For an image of a fabric, digital image processing module 250 may be configured to process the image to determine a fabric type. There are several methods known in the art for identifying a fabric type using digital image processing. These methods include identifying the fabric type based on weave pattern or identifying the fabric type based on light reflection. Any method of digital image processing to identify a fabric type may be used. For an image of a label containing instructions for ironing, digital image processing module 250 may be configured to extract text from the image using optical character recognition (OCR) and further configured to determine the ironing instructions using natural language processing. In some embodiments, digital image processing module 250 may be configured to identify symbols in the image which correspond to ironing instructions. For example, some labels have a symbol in the shape of an iron with dots which indicate a general temperature for ironing. Audio processing module 280 may be configured to extract a fabric type from audio received from ironing device 210 using speech recognition to convert the audio to text.

Iron settings selection module 260 may be configured to select a set of iron settings based on a fabric type determined by digital image processing module 250 or audio processing module 280, or based on ironing instructions determined by digital image processing module 250. Iron settings selection module 260 may further use information about the ironing device, such as make and model to determine iron settings. Iron settings selection module 260 may reference an iron settings database in determining the set of iron settings. Iron settings database 270 may contain multiple fabric types and a set of iron settings for each fabric type. Iron settings database 270 may contain different settings for different makes and models of ironing devices. Iron settings database 270 may be updated by a host of the database to include new ironing devices, new fabrics, or to adjust settings for fabrics. The set of settings selected by iron settings selection module 260 may be communicated to ironing device 210 via network 230 and wireless access point 220.

In some embodiments, iron settings selection module will determine settings based on several inputs. Where there are conflicts between inputs, this may include applying rules to determine which inputs take precedence.

Figure 3:
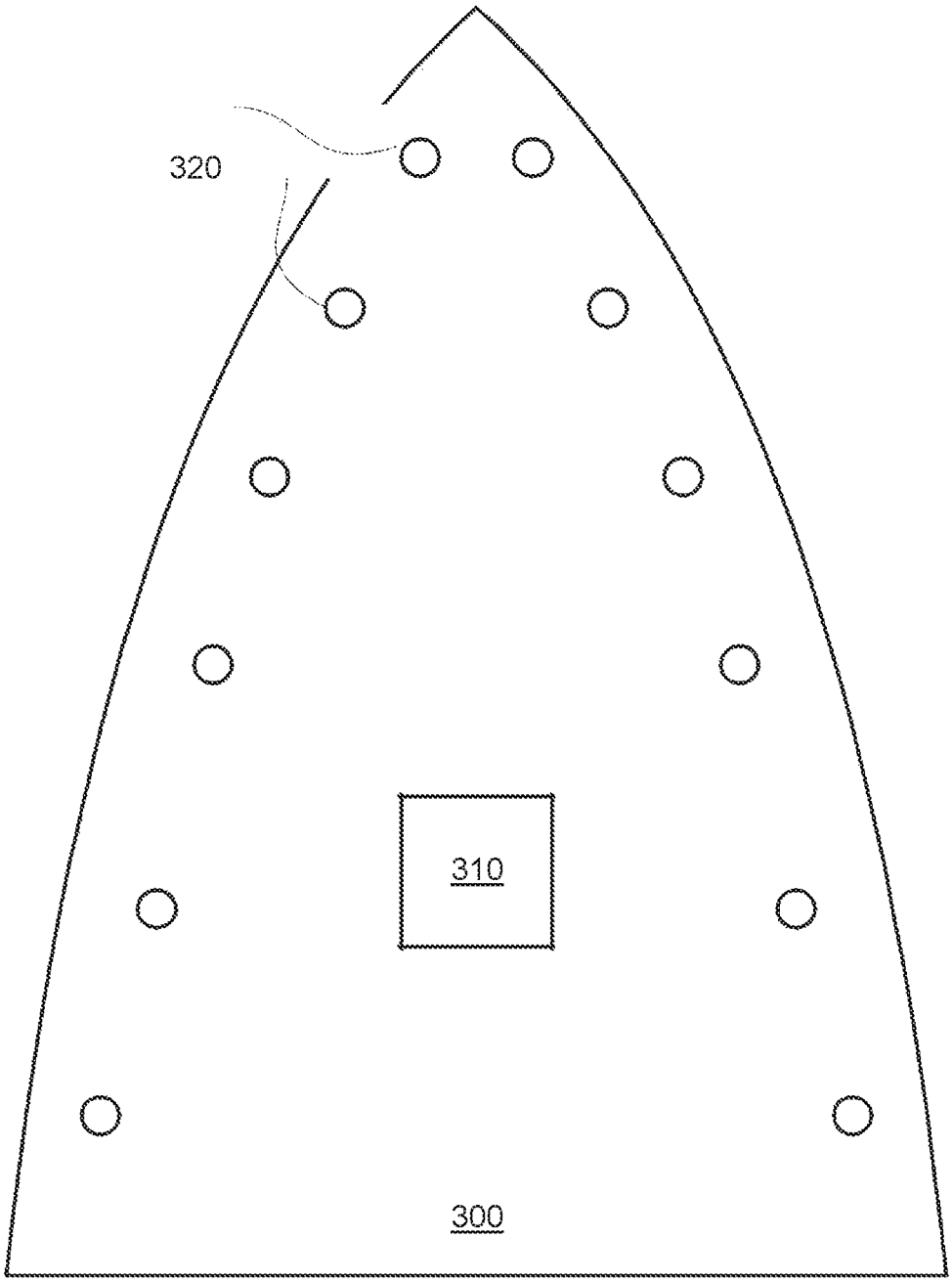
FIG. 3 depicts an example soleplate for an ironing device with automated selection of ironing settings.

Referring to FIG. 3, an example soleplate 300 is depicted. Soleplate 300 has a cutout 310 through which a digital camera can capture images. Soleplate 300 further contains steam holes 320 which allow steam to pass through soleplate 300 and on to a fabric while ironing. Soleplate 300, as depicted, is merely an example soleplate and could vary in shape and layout without departing from the scope of the present disclosure. For example, cutout 310 could be a different shape and be placed elsewhere on the soleplate. Further, steam holes 320 may be different shapes and may be arranged differently on soleplate 300. In some embodiments, soleplate 300 may not have steam holes, for example, if the ironing device does not produce steam.

Figure 4:
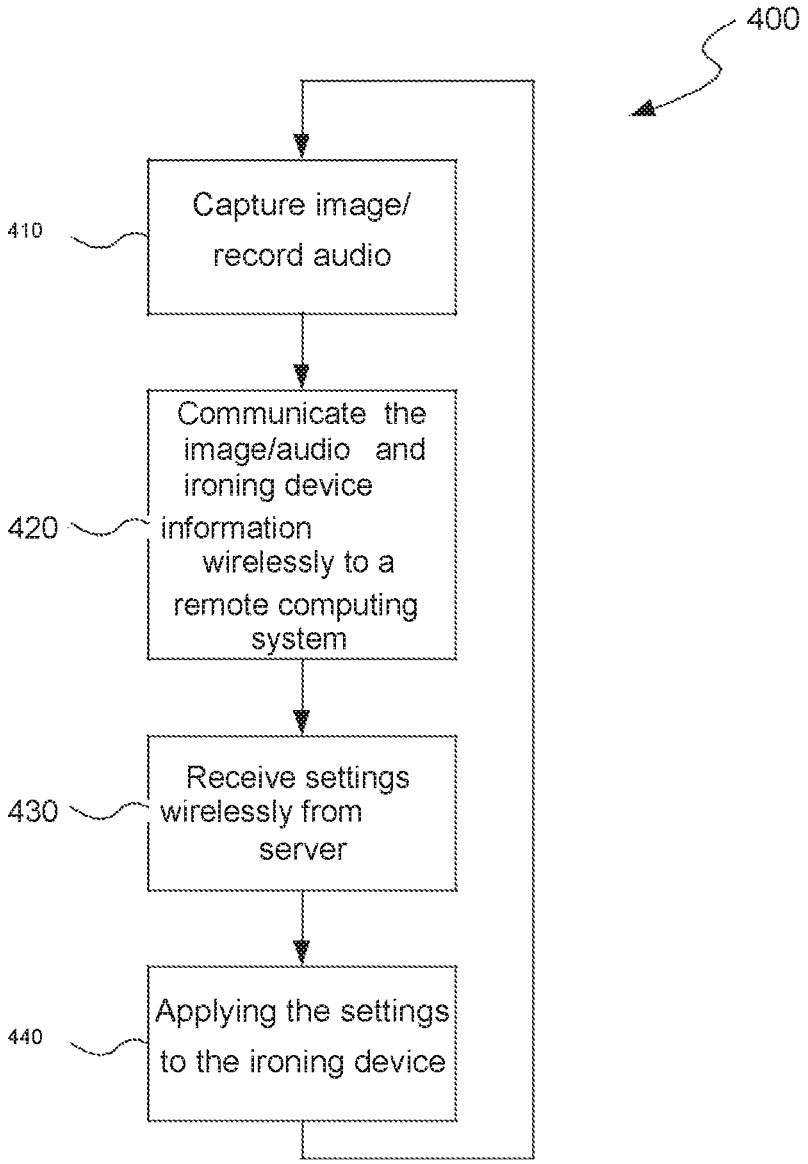
FIG. 4 depicts a flow diagram of an example method for automated selection of settings by ironing device.

Referring to FIG. 4, a flow diagram of an example method 400 for automated selection of settings by an ironing device. At block 410, an image is captured or audio is recorded at an ironing device using a digital camera or a microphone. At block 420, the image or audio is communicated through a wireless device to a remote computing system for processing and selection of settings. The ironing device may also send information about its make/model to the remote computing system. At block 430, the settings are received from the remote computing system using the wireless device. At block 440, the settings are applied to the ironing device.

In some embodiments, the ironing device continually captures images and communicates them to the remote computing device to continuously update the settings on the ironing device. In these embodiments, method 400 may repeat continuously.

Figure 5:
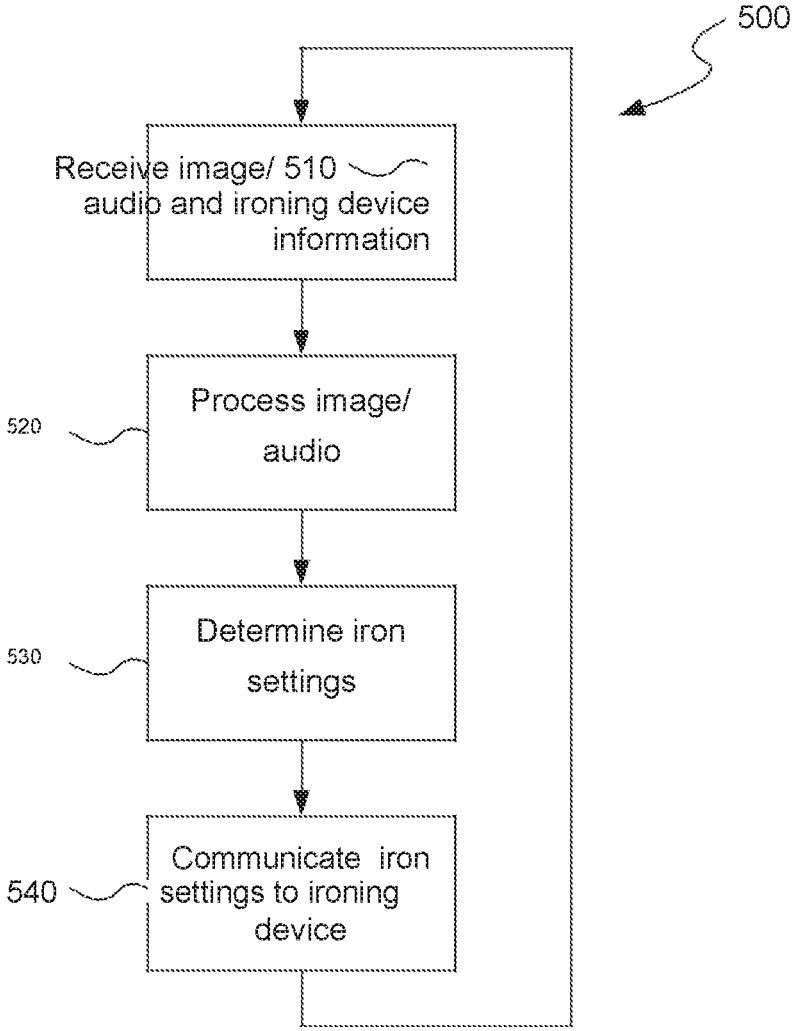
FIG. 5 depicts a flow diagram of an example method for automated selection of settings by a computing system.

Referring to FIG. 5, a flow diagram of an example method 500 for automated selection of settings by a computing system is depicted. At block 510, an image or audio is received from an ironing device. The computing system may also receive information about the ironing device such as make/model information. At block 520, the image or audio is processed to identify a fabric type or ironing instructions as described herein. At block 530, iron settings are determined based on the fabric type or ironing instructions. Determination of iron settings may also take into account information about the ironing device. At block 540, the iron settings are communicated to the ironing device.

In some embodiments, the computing system may continuously receive images from the ironing device. In these embodiments, method 500 may repeat continuously.

Figure 6:
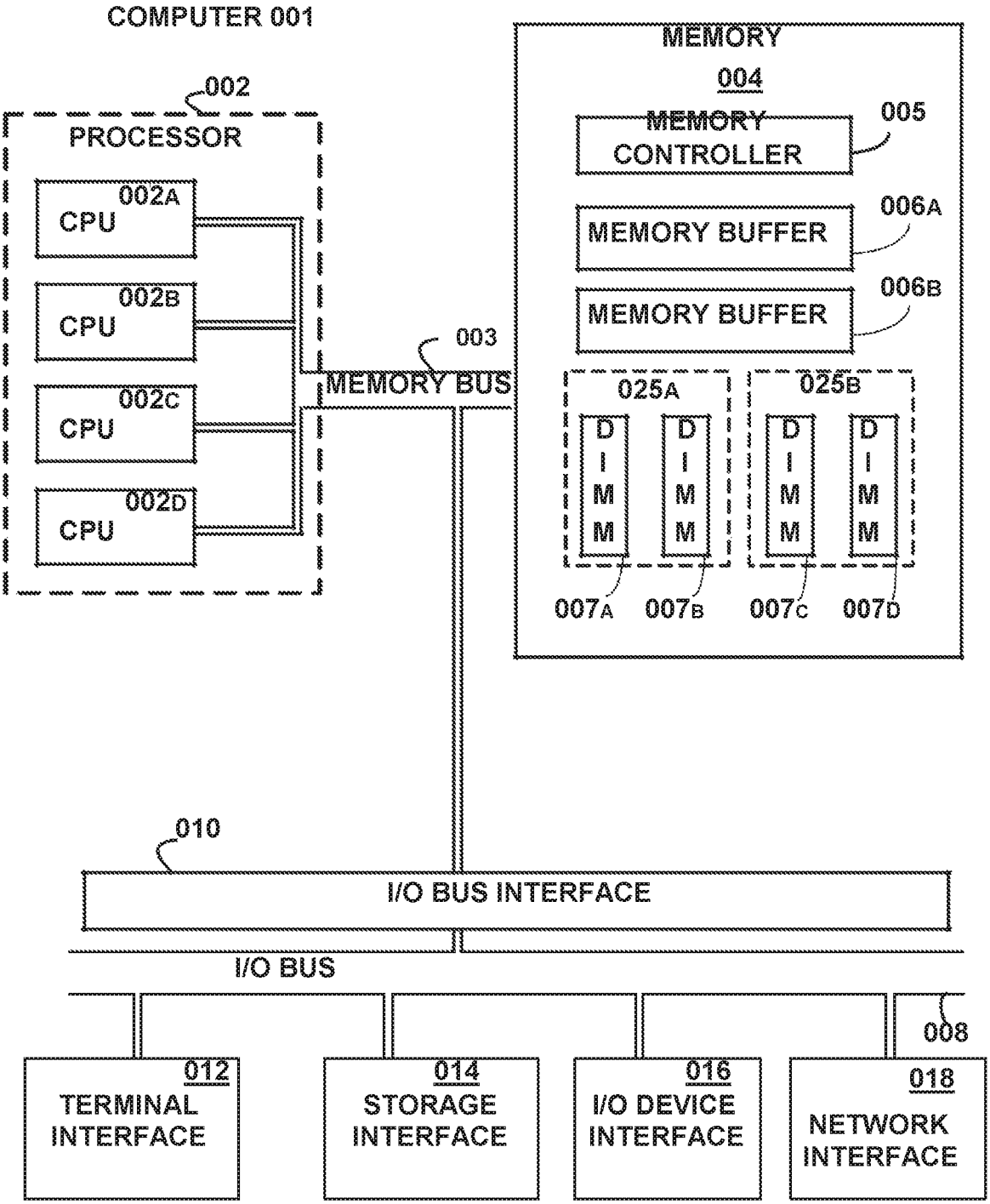
FIG. 6 depicts a high-level block diagram of an example computing system for implementing one or more embodiments of the invention.

Referring to FIG. 6, a high-level block diagram of an example computing system for implementing one or more embodiments of the invention, is depicted. The mechanisms and apparatus of embodiments of the present invention apply equally to any appropriate computing system. The major components of the computer system 001 comprise one or more CPUs 002, a memory subsystem 004, a terminal interface 012, a storage interface 014, an I/O (Input/Output) device interface 016, and a network interface 018, all of which are communicatively coupled, directly or indirectly, for inter-component communication via a memory bus 003, an I/O bus 008, and an I/O bus interface unit 010.

The computer system 001 may contain one or more general-purpose programmable central processing units (CPUs) 002A, 002B, 002C, and 002D, herein generically referred to as the CPU 002. In an embodiment, the computer system 001 may contain multiple processors typical of a relatively large system; however, in another embodiment the computer system 001 may alternatively be a single CPU system. Each CPU 002 executes instructions stored in the memory subsystem 004 and may comprise one or more levels of on-board cache.

In an embodiment, the memory subsystem 004 may comprise a random-access semiconductor memory, storage device, or storage medium (either volatile or non-volatile) for storing data and programs. In another embodiment, the memory subsystem 004 may represent the entire virtual memory of the computer system 001, and may also include the virtual memory of other computer systems coupled to the computer system 001 or connected via a network. The memory subsystem 004 may be conceptually a single monolithic entity, but in other embodiments the memory subsystem 004 may be a more complex arrangement, such as a hierarchy of caches and other memory devices. For example, memory may exist in multiple levels of caches, and these caches may be further divided by function, so that one cache holds instructions while another holds non-instruction data, which is used by the processor or processors. Memory may be further distributed and associated with different CPUs or sets of CPUs, as is known in any of various so-called non-uniform memory access (NUMA) computer architectures.

The main memory or memory subsystem 004 may contain elements for control and flow of memory used by the CPU 002. This may include all or a portion of the following: a memory controller 005, one or more memory buffer 006 and one or more memory devices 007. In the illustrated embodiment, the memory devices 007 may be dual in-line memory modules (DIMMs), which are a series of dynamic random-access memory (DRAM) chips mounted on a printed circuit board and designed for use in personal computers, workstations, and servers. In various embodiments, these elements may be connected with buses for communication of data and instructions. In other embodiments, these elements may be combined into single chips that perform multiple duties or integrated into various types of memory modules. The illustrated elements are shown as being contained within the memory subsystem 004 in the computer system 001. In other embodiments the components may be arranged differently and have a variety of configurations. For example, the memory controller 005 may be on the CPU 002 side of the memory bus 003. In other embodiments, some or all of them may be on different computer systems and may be accessed remotely, e.g., via a network.

Although the memory bus 003 is shown in FIG. 6 as a single bus structure providing a direct communication path among the CPUs 002, the memory subsystem 004, and the I/O bus interface 010, the memory bus 003 may in fact comprise multiple different buses or communication paths, which may be arranged in any of various forms, such as point-to-point links in hierarchical, star or web configurations, multiple hierarchical buses, parallel and redundant paths, or any other appropriate type of configuration. Furthermore, while the I/O bus interface 010 and the I/O bus 008 are shown as single respective units, the computer system 001 may, in fact, contain multiple I/O bus interface units 010, multiple I/O buses 008, or both. While multiple I/O interface units are shown, which separate the I/O bus 008 from various communications paths running to the various I/O devices, in other embodiments some or all of the I/O devices are connected directly to one or more system I/O buses.

In various embodiments, the computer system 001 is a multi-user mainframe computer system, a single-user system, or a server computer or similar device that has little or no direct user interface, but receives requests from other computer systems (clients). In other embodiments, the computer system 001 is implemented as a desktop computer, portable computer, laptop or notebook computer, tablet computer, pocket computer, telephone, smart phone, network switches or routers, or any other appropriate type of electronic device.

FIG. 6 is intended to depict the representative major components of an exemplary computer system 001. But individual components may have greater complexity than represented in FIG. 6, components other than or in addition to those shown in FIG. 6 may be present, and the number, type, and configuration of such components may vary. Several particular examples of such complexities or additional variations are disclosed herein. The particular examples disclosed are for example only and are not necessarily the only such variations.

The memory buffer 006, in this embodiment, may be intelligent memory buffer, each of which includes an exemplary type of logic module. Such logic modules may include hardware, firmware, or both for a variety of operations and tasks, examples of which include: data buffering, data splitting, and data routing. The logic module for memory buffer 006 may control the DIMMs 007, the data flow between the DIMM 007 and memory buffer 006, and data flow with outside elements, such as the memory controller 005. Outside elements, such as the memory controller 005 may have their own logic modules that the logic module of memory buffer 006 interacts with. The logic modules may be used for failure detection and correcting techniques for failures that may occur in the DIMMs 007. Examples of such techniques include: Error Correcting Code (ECC), Built-In-Self-Test (BIST), extended exercisers, and scrub functions. The firmware or hardware may add additional sections of data for failure determination as the data is passed through the system. Logic modules throughout the system, including but not limited to the memory buffer 006, memory controller 005, CPU 002, and even the DRAM may use these techniques in the same or different forms. These logic modules may communicate failures and changes to memory usage to a hypervisor or operating system. The hypervisor or the operating system may be a system that is used to map memory in the system 001 and tracks the location of data in memory systems used by the CPU 002. In embodiments that combine or rearrange elements, aspects of the firmware, hardware, or logic modules capabilities may be combined or redistributed. These variations would be apparent to one skilled in the art.

Figure 7:
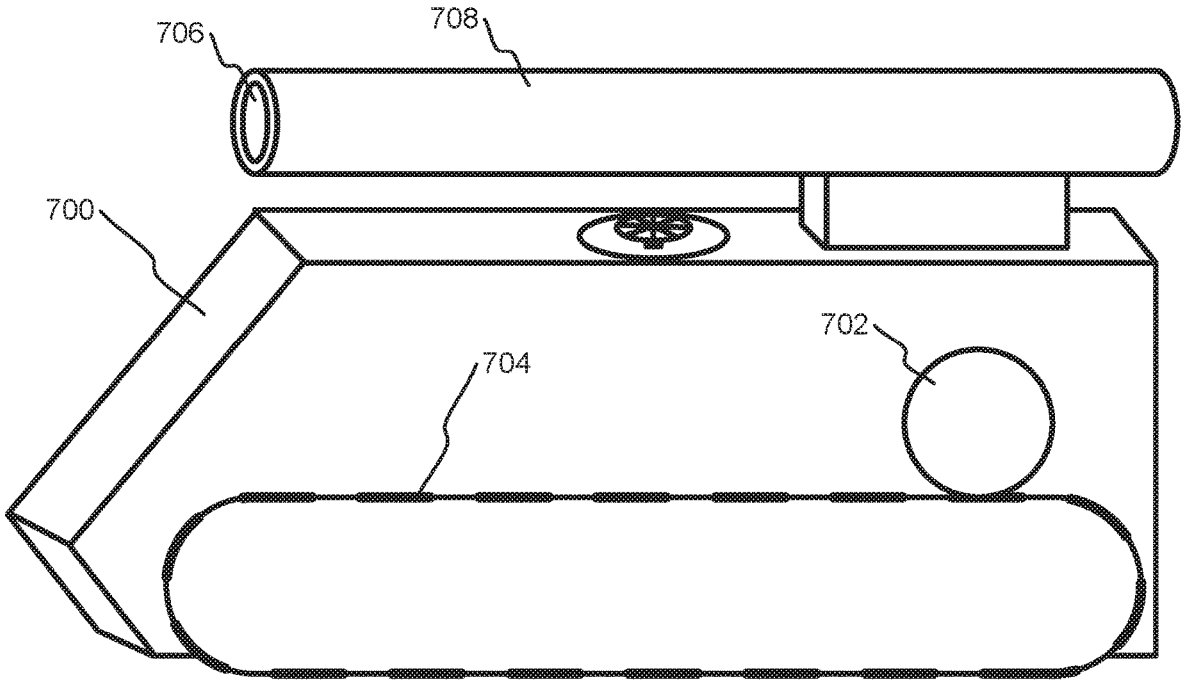
FIG. 7 depicts an example iron with an automatic drive system.

Referring to FIG. 7, an example iron 700 with automatic-drive capability is depicted. Electronic motor 702 is configured to drive tracks 704, which propel the iron at the speed at which the iron is set. For example, iron 700 may receive a set of settings from a remote computer system. The set of settings may include a speed setting based on the type of and thickness of the fabric that iron 700 is ironing. Touch sensor 706 may be configured to activate the automatic drive system when a user is gripping handle 708.

The present invention may be a system, a method, and/or a computer program product. The computer program product may include a computer readable storage medium (or media) having computer readable program instructions thereon for causing a processor to carry out aspects of the present invention.

The computer readable storage medium can be a tangible device that can retain and store instructions for use by an instruction execution device. The computer readable storage medium may be, for example, but is not limited to, an electronic storage device, a magnetic storage device, an optical storage device, an electromagnetic storage device, a semiconductor storage device, or any suitable combination of the foregoing. A non-exhaustive list of more specific examples of the computer readable storage medium includes the following: a portable computer diskette, a hard disk, a random access memory (RAM), a read-only memory (ROM), an erasable programmable read-only memory (EPROM or Flash memory), a static random access memory (SRAM), a portable compact disc read-only memory (CD-ROM), a digital versatile disk (DVD), a memory stick, a floppy disk, a mechanically encoded device such as punch-cards or raised structures in a groove having instructions recorded thereon, and any suitable combination of the foregoing. A computer readable storage medium, as used herein, is not to be construed as being transitory signals per se, such as radio waves or other freely propagating electromagnetic waves, electromagnetic waves propagating through a waveguide or other transmission media (e.g., light pulses passing through a fiber-optic cable), or electrical signals transmitted through a wire.

Computer readable program instructions described herein can be downloaded to respective computing/processing devices from a computer readable storage medium or to an external computer or external storage device via a network, for example, the Internet, a local area network, a wide area network and/or a wireless network. The network may comprise copper transmission cables, optical transmission fibers, wireless transmission, routers, firewalls, switches, gateway computers and/or edge servers. A network adapter card or network interface in each computing/processing device receives computer readable program instructions from the network and forwards the computer readable program instructions for storage in a computer readable storage medium within the respective computing/processing device.

Computer readable program instructions for carrying out operations of the present invention may be assembler instructions, instruction-set-architecture (ISA) instructions, machine instructions, machine dependent instructions, microcode, firmware instructions, state-setting data, or either source code or object code written in any combination of one or more programming languages, including an object oriented programming language such as Smalltalk, C++ or the like, and conventional procedural programming languages, such as the "C" programming language or similar programming languages. The computer readable program instructions may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider). In some embodiments, electronic circuitry including, for example, programmable logic circuitry, field-programmable gate arrays (FPGA), or programmable logic arrays (PLA) may execute the computer readable program instructions by utilizing state information of the computer readable program instructions to personalize the electronic circuitry, in order to perform aspects of the present invention.

Aspects of the present invention are described herein with reference to flowchart illustrations and/or block diagrams of methods, apparatus (systems), and computer program products according to embodiments of the invention. It will be understood that each block of the flowchart illustrations and/or block diagrams, and combinations of blocks in the flowchart illustrations and/or block diagrams, can be implemented by computer readable program instructions.

These computer readable program instructions may be provided to a processor of a general purpose computer, special purpose computer, or other programmable data processing apparatus to produce a machine, such that the instructions, which execute via the processor of the computer or other programmable data processing apparatus, create means for implementing the functions/acts specified in the flowchart and/or block diagram block or blocks. These computer readable program instructions may also be stored in a computer readable storage medium that can direct a computer, a programmable data processing apparatus, and/or other devices to function in a particular manner, such that the computer readable storage medium having instructions stored therein comprises an article of manufacture including instructions which implement aspects of the function/act specified in the flowchart and/or block diagram block or blocks.

The computer readable program instructions may also be loaded onto a computer, other programmable data processing apparatus, or other device to cause a series of operational steps to be performed on the computer, other programmable apparatus or other device to produce a computer implemented process, such that the instructions which execute on the computer, other programmable apparatus, or other device implement the functions/acts specified in the flowchart and/or block diagram block or blocks.

The flowchart and block diagrams in the Figures illustrate the architecture, functionality, and operation of possible implementations of systems, methods, and computer program products according to various embodiments of the present invention. In this regard, each block in the flowchart or block diagrams may represent a module, segment, or portion of instructions, which comprises one or more executable instructions for implementing the specified logical function(s). In some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts or carry out combinations of special purpose hardware and computer instructions.

The descriptions of the various embodiments of the present disclosure have been presented for purposes of illustration, but are not intended to be exhaustive or limited to the embodiments disclosed. Many modifications and variations will be apparent to those of ordinary skill in the art without departing from the scope and spirit of the described embodiments. The terminology used herein was chosen to explain the principles of the embodiments, the practical application or technical improvement over technologies found in the marketplace, or to enable others of ordinary skill in the art to understand the embodiments disclosed herein.

What is claimed is:

1. An ironing device, the device comprising:

a soleplate;

a thermostat configured to maintain the soleplate at a set temperature;

a digital camera configured to capture a first image of a fabric;

a wireless communication device configured to transmit the first image of the fabric to a remote computing system for digital image processing to determine a first fabric type and to select a set of settings based on the first fabric type, the wireless communication device further configured to receive a set of settings from the remote computing system;

a settings control module configured to receive the set of settings from the wireless communication device, the settings control module further configured to apply the set of settings to the ironing device; and a speaker configured to produce noise while the device settings are changing.

2. The ironing device of claim 1, wherein the set of settings comprises a heat setting, and wherein the applying the set of settings to the ironing device comprises adjusting a temperature of a soleplate on the ironing device based on the heat setting.

3. The ironing device of claim 1, wherein the set of settings comprises a steam setting, and wherein the applying the set of settings to the ironing device comprises adjusting an amount of steam produced based on the steam setting.

4. The ironing device of claim 1, wherein the set of settings comprises a speed setting, and wherein the applying the set of settings to the ironing device comprises adjusting an automated speed for the ironing device based on the speed setting.

5. The ironing device of claim 1, further comprising:

capturing, by the digital camera, a second image of a label comprising ironing instructions;

communicating, by the wireless communication device, the second image to the remote computing system for processing to extract the ironing instructions, wherein the set of settings is further based on the ironing instructions.

6. The ironing device of claim 1, further comprising:

recording, by a microphone on the ironing device, audio identifying a second fabric type;

communicating, by the wireless communication device, the audio to the remote computing system to extract the second fabric type using speech recognition, wherein the set of settings is further based on the second fabric type.

7. The ironing device of claim 1, further comprising communicating, by the wireless communication device, information about the ironing device to the remote computing system, wherein the set of settings is further based on the information about the ironing device.

8. A system comprising:

a processor; and a memory in communication with the processor, the memory containing program instructions that, when executed by the processor, are configured to cause the processor to perform a method, the method comprising:

receiving, from an ironing device with a wireless communication device, audio identifying a first fabric type;

extracting the first fabric type from the audio using speech recognition;

receiving, from the ironing device, the ironing device's make and model;

determining a set of settings based on the first fabric type, wherein the set of settings comprises a temperature setting and is based in part on the make and model of the ironing device; and communicating the set of settings to the ironing device.

9. The system of claim 8, wherein the determining the set of settings based on the first fabric type comprises identifying, in an iron settings database, the set of settings, the set of settings associated with the first fabric type, the iron settings database comprising a plurality of fabric types and iron settings associated with each of the plurality of fabric types.

10. The system of claim 8, wherein the set of settings comprises a temperature setting.

11. The system of claim 8, wherein the set of settings comprises a steam setting.

12. The system of claim 8, the method further comprising:

receiving, from the ironing device, a digital image of a label comprising ironing instructions; and extracting the ironing instructions from the digital image of the label, wherein the set of settings is further based on the ironing instructions.

* * * * *